US005579964A

United States Patent [19]

Fochtman

[11] Patent Number: 5,579,964

[45] Date of Patent: Dec. 3, 1996

[54] HANGER EXTENSION KIT

[76] Inventor: Lester Fochtman, 2316 Edgely Ave., Levittown, Pa. 19057

[21] Appl. No.: 419,431

[22] Filed: Apr. 10, 1995

[51] Int. Cl.[6] ..... A47G 25/42; A47G 25/46

[52] U.S. Cl. ..... 223/94; 223/89; 223/85

[58] Field of Search ..... 223/85, 88, 89, 223/92, 94; D6/315, 328

[56] References Cited

U.S. PATENT DOCUMENTS

| | | | |
|---|---|---|---|
| 2,360,119 | 10/1944 | Gallagher | 223/89 |
| 2,531,293 | 11/1950 | Paulsen | 223/89 |
| 2,621,834 | 12/1952 | Irving | 223/89 |
| 2,682,978 | 7/1954 | Brock | 223/89 |
| 4,334,641 | 6/1982 | Narcum | 223/94 |
| 5,052,599 | 10/1991 | Platti | 223/94 |

*Primary Examiner*—Bibhu Mohanty

[57] ABSTRACT

The hanger extension kit includes at least one extension member arranged for adjustable securement relative to a conventional hanger at a junction of the hanger's base rod to a side rod, with the extension member having a generally U-shaped configuration, with a semi-circular junction defining spaced rod members, wherein the spaced rod members each include a plurality of resilient fasteners. The resilient fasteners are arranged to engage the hanger member's base and side rod structure. The kit further includes at least one L-shaped hook member having first and second legs, with the second leg fixedly received within a clamp body, and the clamp body of resilient construction having an elongate groove parallel to the second leg, and the elongate groove of a generally semi-circular cross-sectional configuration arranged to engage the base rod permitting the first leg to extend beyond the hanger.

3 Claims, 3 Drawing Sheets

HANGER EXTENSION KIT

TECHNICAL FIELD

The field of invention relates to clothes hanger construction, and more particularly to a kit assembly permitting the opposed ends of a hanger member to be extended to more readily accommodate clothes preventing their undesirable fall from the associated hanger member.

BACKGROUND OF THE INVENTION

Prior art hanger member structure of exemplary consideration are indicated in U.S. Pat. Nos. 3,540,601; 4,334,641; 4,717,053; 5,052,599; and 5,197,639.

The instant invention is directed to a kit construction to permit accessory support structure to be securely attached to opposed ends of a hanger in an adjustable relationship to secure the kit members to provide support for garments to be supported by the associated hanger member.

SUMMARY OF THE INVENTION

The hanger extension kit includes at least one extension member arranged for adjustable securement relative to a conventional hanger at a junction of the hanger's base rod to a side rod, with the extension member having a generally U-shaped configuration, with a semi-circular junction defining spaced rod members, wherein the spaced rod members each include a plurality of resilient fasteners. The resilient fasteners are arranged to engage the hanger member's base and side rod structure. The kit further includes at least one L-shaped hook member having first and second legs, with the second leg fixedly received within a clamp body, and the clamp body of resilient construction having an elongate groove parallel to the second leg, and the elongate groove of a generally semi-circular cross-sectional configuration arranged to engage the base rod permitting the first leg to extend beyond the hanger.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
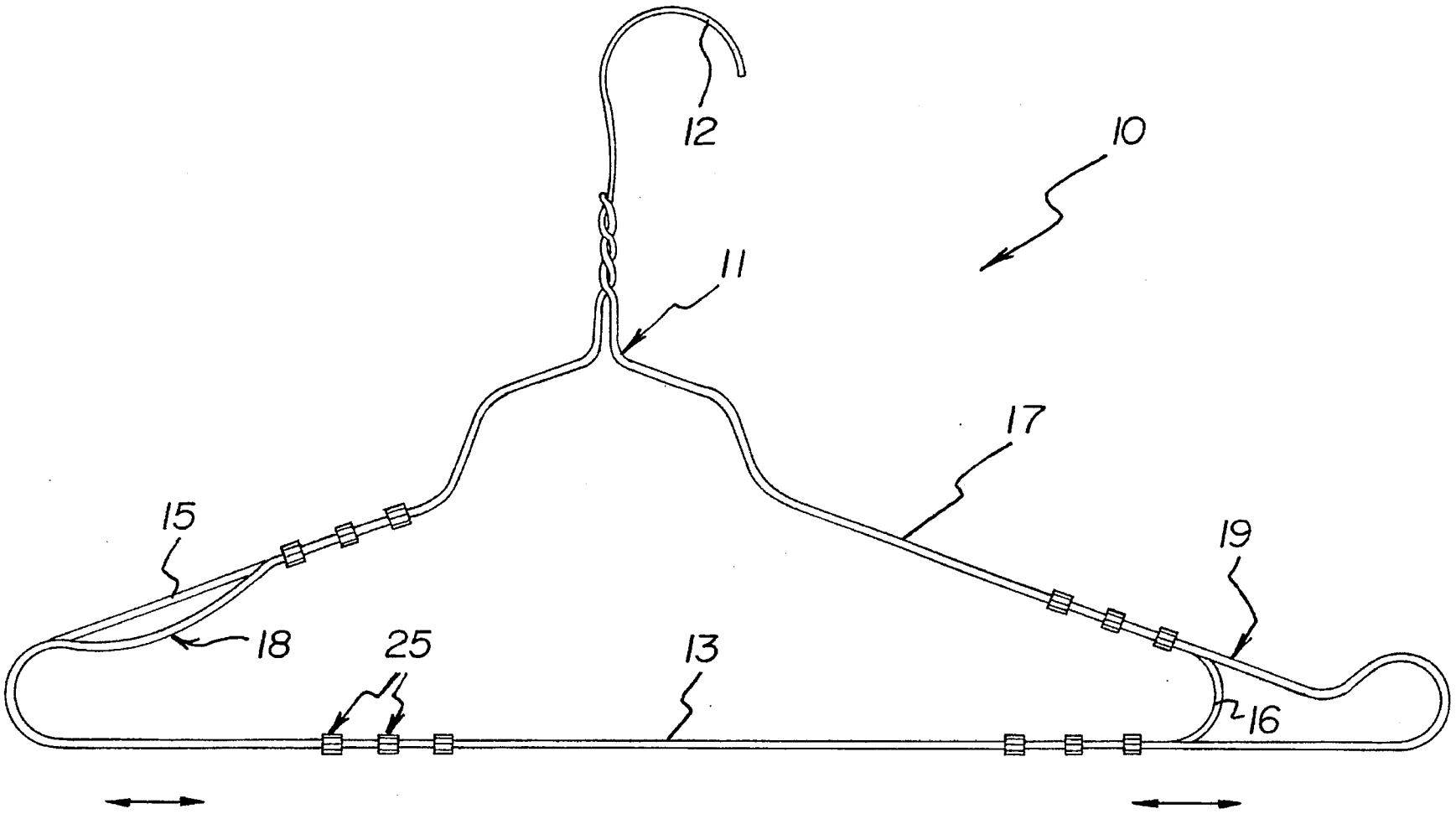
FIG. 1 is a frontal view, taken in elevation, of the invention.
Figure 3:
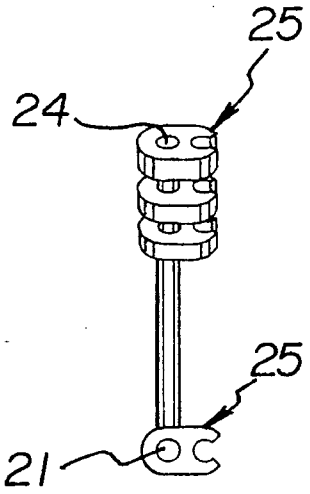
FIG. 3 is an end view of the extension member.

The hanger extension kit 10 of the invention comprises at least one and typically a plurality of first and second extension members 18 and 19 arranged for securement to a hanger member 11, as indicated in FIG. 1. The hanger member 11 is formed with a support hook 12 spaced from a hanger base rod 13, with the base rod 13 terminating in respective first and second arcuate intersections 14 and 16 that extend into respective first and second side rods 15 and 17, that in turn are arranged to engage the support hook 12. The first and second side rods 15 and 17 typically are oriented relative to the base rod at an acute included angle therebetween. Each of the first and second extension members 18 and 19 are of a like construction, with the first extension 18 arranged to engage with the first side rod 15 and the base rod 13, with the second extension rod 19 arranged to engage the base rod 13 and the second side rod 17.

Figure 2:
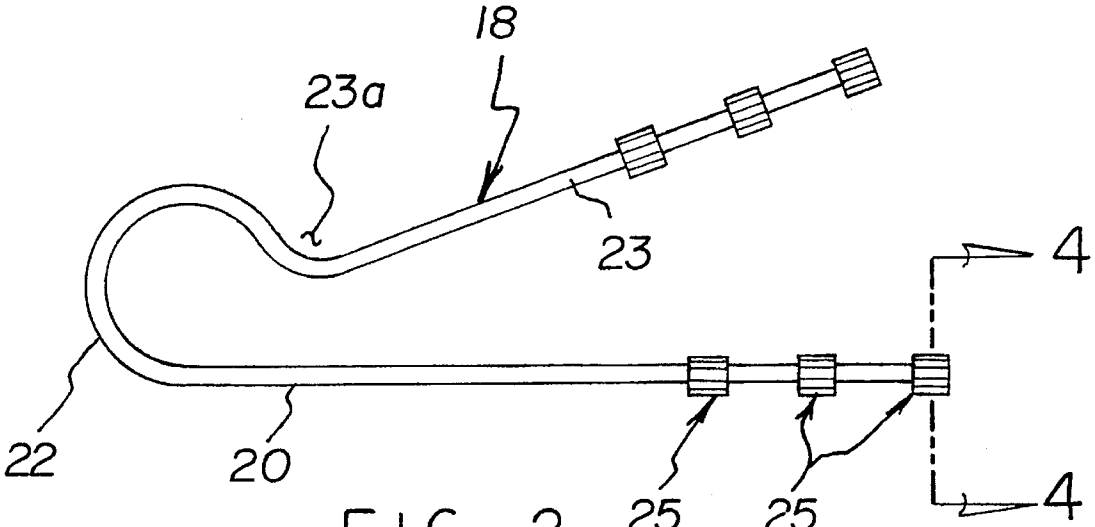
FIG. 2 is an elevational view of at least one of the extension members.

Each of the first and second extension members 18 and 19 (see FIG. 2) includes a first rod 20 extending to a second rod 23 at an acute included angle therebetween at a semi-circular loop 22. The first rod 20 terminates in a first rod free end 21, with the second rod 23 terminating in a second rod free end 24. It should be noted that the semi-circular loop 22 extends beyond the second rod 23 to define a second rod recess **23*a* at an intersection of the loop 22 to the second rod 23 to enhance engagement of a garment as the loop thereby functions as an abutment at its intersection with the second rod 23**.

Figure 4:
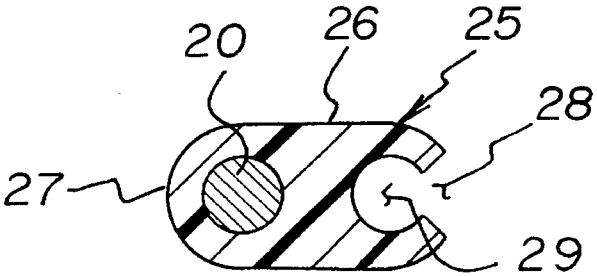
FIG. 4 is a cross-sectional illustration, taken along the lines 4—4 of FIG. 2 as indicated.

The first and second rods 20 and 23 each include a plurality of resilient fasteners 25 secured thereto, with the resilient fasteners spaced from the first and second rod free ends 21 and 24 respectively. Each of the resilient fasteners 25 includes a body flange 26 orthogonally oriented relative to the respective first and second rods 20 and 23 that are received through the body flange 26. To this end, the body flange 26 (see FIG. 4) includes a body flange first end 27 having the associated rod structure as indicated with the first rod 20 in FIG. 4 directed through the body flange in an orthogonal relationship, and the body flange second end defines a body flange second end opening 28 of an arcuate length less than 180 degrees extending into a semi-cylindrical cavity 29 from the second end opening 28. The resilient construction of the body flange 26 permits engagement of the hanger base rod 13 relative to the resilient fasteners 25 secured to the first rod 20, with the resilient fasteners secured to the second rod 23 arranged to resiliently engage the first side rod 15 in use of the first extension member 18, and likewise arranged to secure the second side rod 17 of the second extension member 19, as indicated in FIG. 1.

Figure 6:
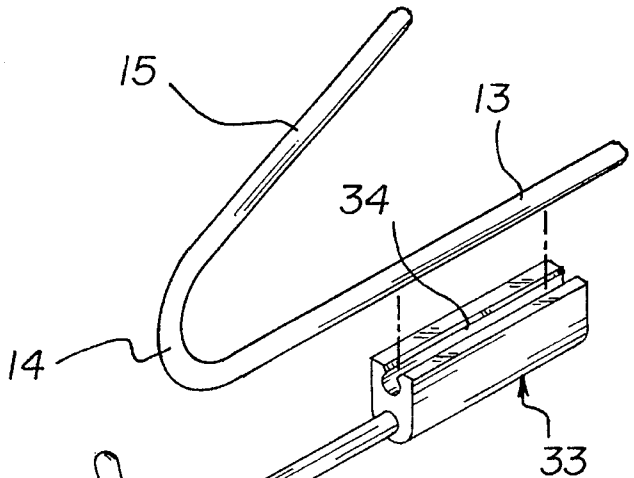
FIG. 6 is an enlarged perspective illustration of the hook member and its securement to the base rod of the hanger member.
Figure 5:
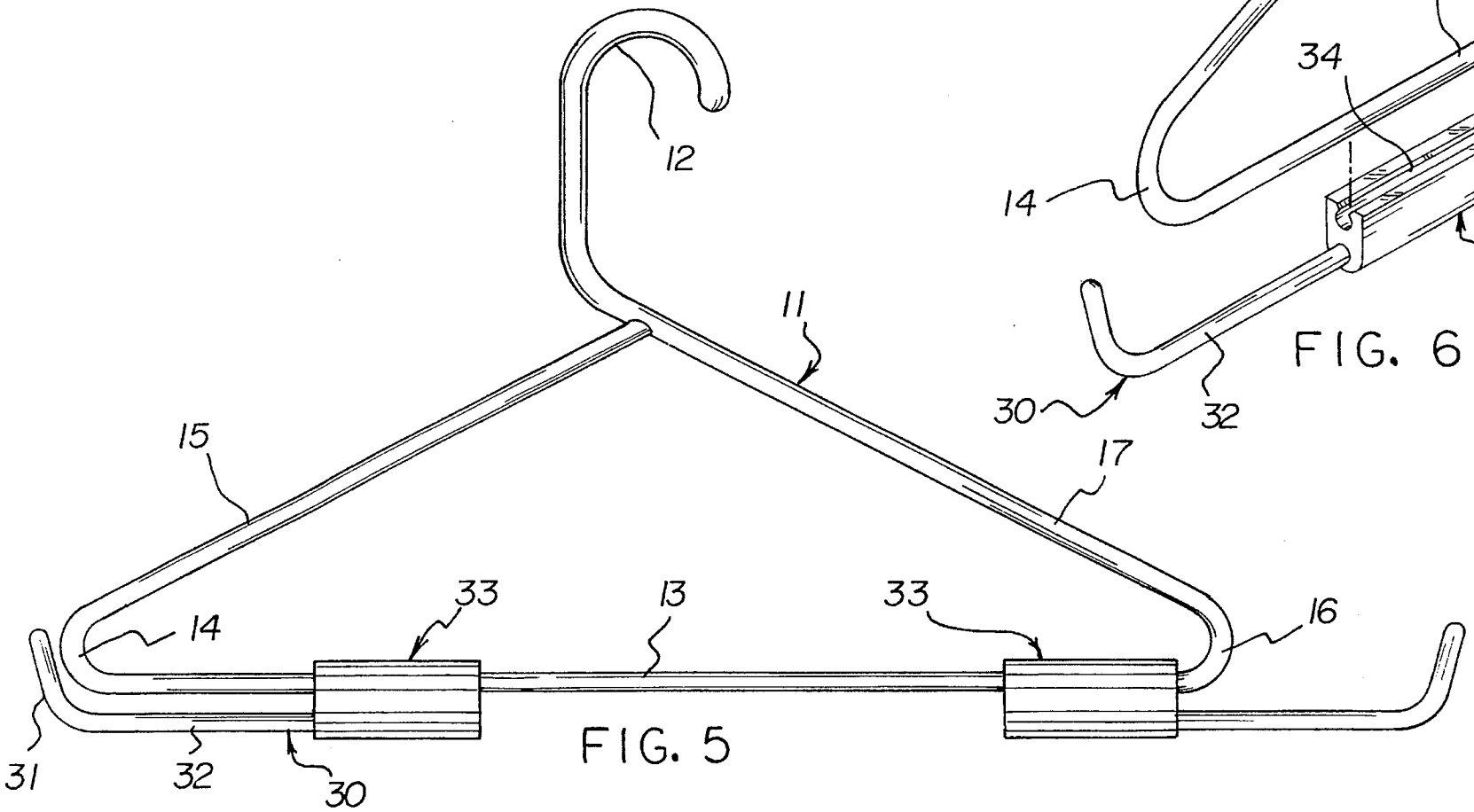
FIG. 5 is an elevational view of the kit structure and the associated L-shaped hook member.

Reference to the FIGS. 5 and 6 provides the kit to further optionally employ in lieu of the first and second extension members 18 and 19, at least one or a plurality of L-shaped hook members 30. Each of the hook members 30 includes a first leg 31 secured to a second leg 32 at a generally oblique angulation, with the first leg 31 of a first length, the second leg 32 of a second length greater than the first length. The second leg 32 is fixedly secured within a clamp body 33, the clamp body 33 having an elongate groove 34 at a periphery of the clamp rod, and the elongate groove of a semi-circular cross-sectional configuration greater than 180 degrees, such that the elongate groove 34 is substantially parallel to the second leg 32, and the elongate 34 arranged to receive the hanger base rod 13 in a clamping resilient relationship.

In use, the first and second extension members 18 and 19, as well as the L-shaped hook members 30, provide for extended length directed to a hanger member to accommodate various garments, as well as the hook members 30 arranged to accommodate various accessories such as belts, ties, and the like if necessary, as well as providing for enhanced engagement of a garment positioned upon an associated hanger member 11.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by LETTERS PATENT of the United States is as follows:

1. A hanger extension kit in combination with a hanger member, the hanger member having a base rod, the base rod including base rod first and second ends terminating in respective first and second arcuate intersections, with the first arcuate intersection directed to a first side rod, and the second arcuate intersection directed to a second side rod, and a support hook, the support hook secured to and receiving the first side rod and the second side rod, and at least one extension member arranged to engage the first side rod and the base rod, the at least one extension member having a first rod and a second rod, the first rod having a first rod free end, the second rod having a second rod free end, and a semi-circular loop, the first rod extending into the semi-circular loop, and the second rod extending into the semi-circular loop, with the first rod and the second rod oriented at an acute angulation relative to one another, and the first rod having a plurality of first fasteners for securement to the base rod, and the second rod having a plurality of second fasteners for securement to the second rod;

the first fasteners each include a first body flange, and the second fasteners each include further body flanges, each said first body flange and said second body flange having an opening defining less than 180 degrees of arc extending into a semi-cylindrical cavity.

2. A kit as set forth in claim 1 including a second extension rod, with the second extension rod arranged for securement to the base rod and the second side rod.

3. A kit as set forth in claim 2 including at least one L-shaped hook member, with the L-shaped hook member having a first leg obliquely secured to a second leg, with the first leg having a first length, the second leg having a second length substantially greater than the first length, and an elongate clamp body, with the second leg fixedly secured within the clamp body, the clamp body having an elongate groove extending into the clamp body, and the elongate groove oriented substantially parallel to the second leg, and the elongate groove having an entrance opening defining less than 180 degrees, and the elongate groove having a semi-circular cross-sectional configuration greater than 180 degrees.

* * * * *